United States Patent [19]

Rosenzopf et al.

[11] 4,357,922

[45] Nov. 9, 1982

[54] METHOD AND APPARATUS FOR OPERATING A FUEL-SUPPLY SYSTEM WITH LAMBDA CONTROL

[75] Inventors: Günter Rosenzopf, Ludwigsburg; Hans Schnürle, Walheim; Wolfgang Rebmann, Vaihingenan der Enz; Ulrich Drews, Vaihingen-Pulverdingen, all of Fed. Rep. of Germany

[73] Assignee: Robert Bosch GmbH, Stuttgart, Fed. Rep. of Germany

[21] Appl. No.: 180,239

[22] Filed: Aug. 22, 1980

Related U.S. Application Data

[63] Continuation of Ser. No. 2,479, Jan. 10, 1979, abandoned.

[30] Foreign Application Priority Data

Feb. 11, 1978 [DE] Fed. Rep. of Germany ..... 2805805

[51] Int. Cl.[3] ..... F02M 51/02

[52] U.S. Cl. ..... 123/489; 123/491

[58] Field of Search ..... 123/491, 489, 440

[56] References Cited

U.S. PATENT DOCUMENTS

| | | | |
|---|---|---|---|
| 3,533,381 | 10/1970 | Schmid et al. | 123/491 |
| 3,916,170 | 10/1975 | Norimatsu et al. | 123/489 |
| 3,923,031 | 12/1975 | Keranan | 123/491 X |
| 4,096,834 | 6/1978 | Norimatsu et al. | 123/489 |
| 4,103,649 | 8/1978 | Matumoto et al. | 123/489 |
| 4,114,570 | 9/1978 | Marchak et al. | 123/491 |
| 4,132,200 | 1/1979 | Asano et al. | 123/440 |
| 4,133,326 | 1/1979 | Cops et al. | 123/491 |
| 4,148,282 | 4/1979 | Grassle et al. | 123/491 |
| 4,155,335 | 5/1979 | Hosaka et al. | 123/489 |

*Primary Examiner*—Tony M. Argenbright
*Attorney, Agent, or Firm*—Edwin E. Greigg

[57] ABSTRACT

A method for operating a fuel-supply system using a lambda-control apparatus for an internal-combustion engine wherein the amount of fuel to be supplied to the internal combustion engine is a function of signals representing the speed (RPM), the engine load, the exhaust-composition, and the temperature of the exhaust-gas sensor together with the attainment of a given temperature of the engine as an additional control criteria for the lambda-control apparatus. The method further includes deriving a temperature signal from the internal combustion engine to operate a threshold element with a hystereses whose switching values lie at about 10° C. and 50° C. to 85° C. for optimum fuel mixture in the combustion chamber. The output signal of the threshold element can be further utilized for a supplementary warm-up fuel enrichment for better ignition characteristics, engine smoothness, and exhaust gas composition. The apparatus according to the invention has transducers for sensing speed, load, exhaust gas composition and temperature together with a threshold element and a logic element for signals from a sensor in the internal combustion engine so that the lambda-control apparatus can be regulated as a function of the output signal from said logic element.

14 Claims, 3 Drawing Figures

METHOD AND APPARATUS FOR OPERATING A FUEL-SUPPLY SYSTEM WITH LAMBDA CONTROL

This is a continuation of application Ser. No. 002,479 filed Jan. 10, 1979 now abandoned.

BACKGROUND OF THE INVENTION

This invention relates to a method and apparatus for operating an internal combustion engine with a fuel supply apparatus and a lambda-control apparatus for the control of the fuel air-mixture based on a certain value where the fuel quantity to be supplied to the engine is regulated in accordance with the signals representing the speed (RPM), engine load, and exhaust gas composition.

It is common practice to activate the lambda-control apparatus after a certain temperature of the exhaust-gas sensor has been reached, after which the air-fuel mixture is adjusted to $\lambda=1$. It has been demonstrated that this procedure leads to unsatisfactory results particularly at low starting temperatures even though the specified temperature of the exhaust-gas sensor is rapidly reached since the air intake pipe to the engine is still so cool that the fuel component of the mixture condenses on the inner walls of the internal combustion engine and no optimum mixture exists in the combustion chamber. This, in turn, impairs both the ignition characteristics, the engine smoothness as well as the exhaust gas composition.

OBJECTS, ADVANTAGES AND SUMMARY OF THE INVENTION

It is a principal object of the invention to provide a method in a internal combustion engine having a fuel supply apparatus and a lambda-control apparatus which regulates the fuel quantity to be supplied to the engine by which the adjustment of the air fuel mixture to $\lambda=1$ advantageously occurs only when a given temperature of the internal combustion engine is reached notwithstanding the fact that the exhaust-gas sensor has reached its minimum temperature. This ensures that the lambda-control apparatus only starts when the optimum mixture can also be provided in a combustion chamber itself.

It is a further object of this invention to provide a threshold element with hysteresis after the temperature sensor for the internal combustion engine to ensure that, for example, with a temperature with the internal combustion engine above approximately 10° C. activation of the lambda-control apparatus depends only on the exhaust-gas sensor temperature, but below a temperature of the internal combustion engine of about 10° C. the lambda-control is not activated until the internal combustion engine has reached the temperature of about 50° to 85° C. The above temperatures, 50° C. and 85° C. have proved to be suitable temperatures but other values may be selected depending upon the type of internal combustion engine and the field of application.

As a further advantage to this invention, the use of the output signal from a threshold element connected after the temperature sensor for the internal combustion engine provides additional control for correcting the error arising from the change in the specific weight of the air above a certain temperature during the measurement of the air quantity. In addition, during starting of the engine at a high temperature is simulated to reduce possible noises during the starting phase caused by heavy load on the electrical system. Further, due to the threshold element, the temperature of the internal combustion engine may be sensed only at the end of the starting of the engine and the lambda-control apparatus be activated only in accordance with the then existing temperatures.

The invention will be better understood as well as further objects and advantages thereof will become more apparent from the ensuring detailed description of the exemplary embodiment taken in conjunction with the drawing.

DESCRIPTION OF THE PREFERRED EMBODIMENT

Figure 1:
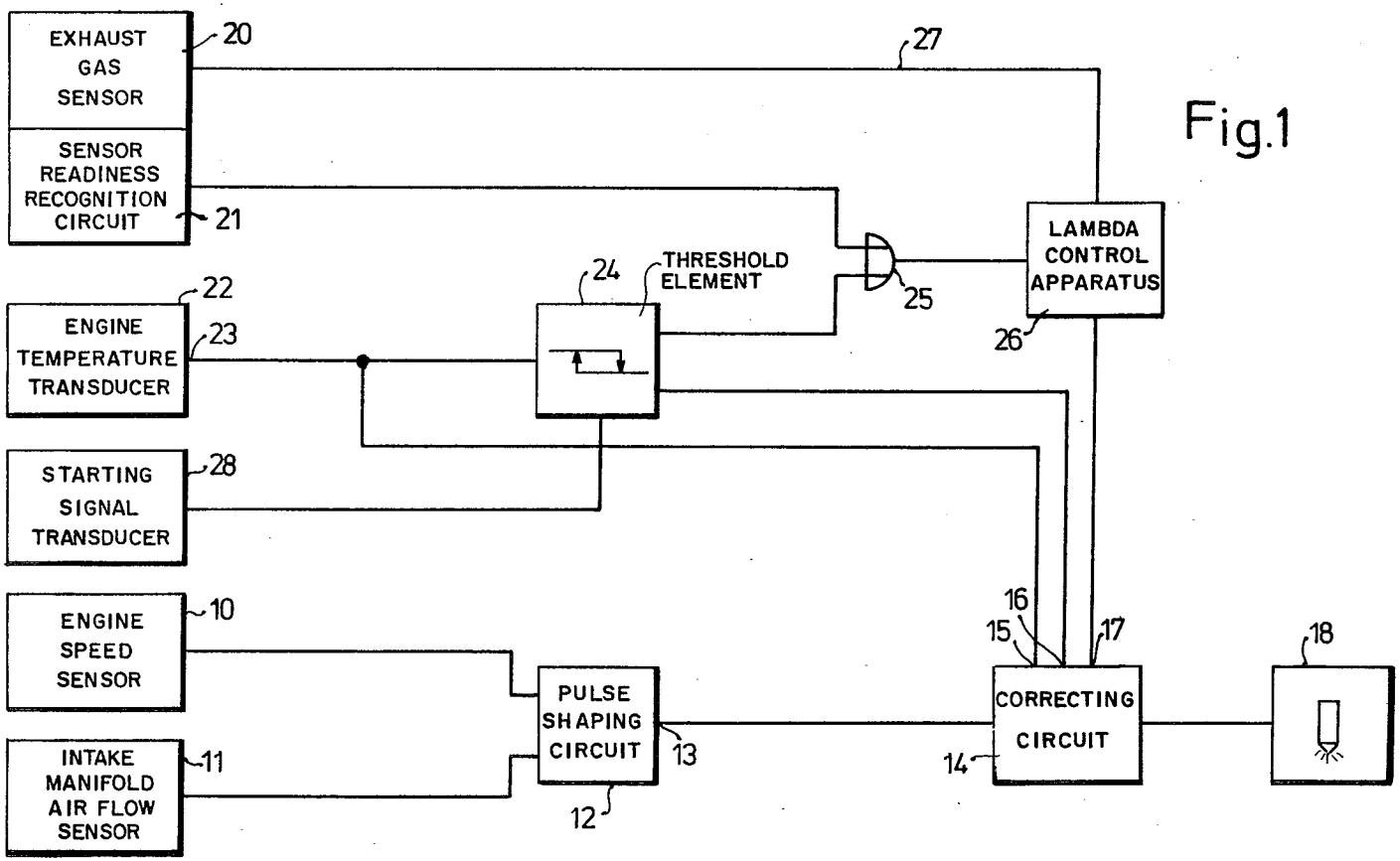
FIG. 1 shows a simplified block diagram of the apparatus embodying the principles of the invention.

The preferred embodiment shown in the drawing relates to the switching arrangement in internal-combustion engines for the shaping of injection pulses for solenoid-operated injection valves. The parts that are the most essential in connection with the invention are illustrated in the drawing.

In FIG. 1 a speed (RPM) sensor is denoted by the numeral 10 and an intake manifold air-flow sensor by the numeral 11. They are coupled with a pulse-shaping circuit 12, whose output 13 is connected to a correcting circuit 14. In the diagram of FIG. 1 said correcting circuit 14 has three inputs 15–17 for engine warm-up enrichment, a supplementary control for eliminating the error of the intake air temperature, and a lambda-control apparatus. Following correcting circuit 14 is block 18 which, for example, has the required driver stages for the injection valves.

Numeral 20 denotes an exhaust-gas sensor to which is assigned a sensor-readiness recognition circuit 21. The exhaust-gas sensor senses the oxygen-ion concentration in the exhaust gas and is also referred to as an oxygen sensor or lambda-sensor where lambda represents the ratio of oxygen to fuel. Transducer 22 for the temperature of the internal-combustion engine senses the temperature of the engine coolant, (or lubricant or cylinder head) and its output 23 is connected to a threshold element 24 with hysteresis. The outlets of the sensor-readiness recognition circuit 21 and threshold element 24 are connected to logic element 25, whose output signal activates the lambda-control apparatus 26. The measuring signal from exhaust-gas sensor 20 is received by the lambda-control apparatus 26 directly via line 27.

Input signals to correcting circuit 14 are, in addition to the output signal of pulse-shaping circuit 12, the output signal of transducer 22 for the temperature of the internal-combustion engine, an output signal of threshold element 24, and the output signal of lambda-control apparatus 26.

Logic element 25 represents an OR gate and it delivers a negative signal when the sensor-readiness recognition circuit 21 delivers a negative signal to indicate that the sensor 20 is ready for service, and likewise when the output of threshold element 24 delivers a negative signal to indicate the presence of an operating temperature which is higher than the threshold temperature. Threshold element 24 with hysteresis is designed such that it delivers a negative signal at starting temperatures above approximately 10° C. If the starting temperature is below this value, threshold element 24 must deliver a negative signal only when sensor 22 indicates a value of about 50° for the internal-combustion engine. The rising portion of threshold element 24 with hysteresis occurs with a value of 10° C. In this operating mode of threshold element 24, the switching arrangement of FIG. 1 operates as follows. With a starting temperature above approximately 10° C., logic element 25 delivers a negative signal only when the exhaust-gas sensor has reached a temperature of about 250° C. Subsequently, lambda-control apparatus 26 is activated and, in turn, again via input 17 exerts an influence on the electrical characteristics of correcting circuit 14.

With starting temperatures below approximately 10° C., threshold element 24 with hysteresis still does not deliver a negative output signal, and logic element 25 switches to a negative value at its output only when, in addition to an exhaust-gas sensor temperature of approximately 250° C. which is sensed by the sensor-readiness recognition circuit 12, the temperature of the internal-combustion engine has also reached a value of approximately 50° C.

As long as logic element 25 still does not deliver a negative signal, lambda-control apparatus 26 delivers a constant signal of a magnitude corresponding to the middle of the control range. Normally, this is the output value of lambda-control apparatus 26 for $\lambda=1$. The constant output value of lambda-control apparatus 26 leads to a control of the air-fuel mixture which is independent of the exhaust-gas composition. Although the exhaust-gas composition at the start of the operation of the internal-combustion engine, until the activation of lambda-control apparatus 26, is not the best possible composition, the error resulting from the adjustment to $\lambda=1$ is nevertheless within bounds and the control after attainment of the predetermined temperatures is initiated without excessive engine roughness.

Correcting circuit 14 receives directly via its input 15 a signal from transducer 22 for the temperature of the internal-combustion engine. This serves to correct a warm-up phase compensation, i.e., the mixture is heavily enriched when the internal-combustion engine is cold and this enrichment will be reduced to zero with increased heating of the internal-combustion engine.

During the air-quantity measuring there arises a temperature error with regard to the change in the specific weight of the air with a different intake-air temperature. This error is corrected when the lambda-control is in operation. It is therefore desirable to correct the error by a supplementary enrichment at lower intake-air temperatures. Said supplementary enrichment is effected with the aid of the output signal of threshold element 24 and via input 16 of correcting circuit 14. Theoretically, the magnitude of the enrichment factor should be temperature-dependent, but excellent results can also be obtained with a mean value throughout the entire temperature range.

The processing of a signal from starting-signal transducer 28 in threshold element 24 serves to reduce possible noises during the starting phase. As is well known, noises are amplified during the starting phase due to the heavy load of the electrical system. It is essential to eliminate said noises vis-a-vis the steps for developing the duration of injection. A practical way is the simulation of a high temperature during the starting. This has no effect on lambda-control apparatus 26, because usually the heating period of exhaust-gas sensor 20 until attainment of the operating temperature lasts considerably longer than the starting itself and thus apparatus 26 already works in the lambda-control range during the starting phase.

Figure 2:
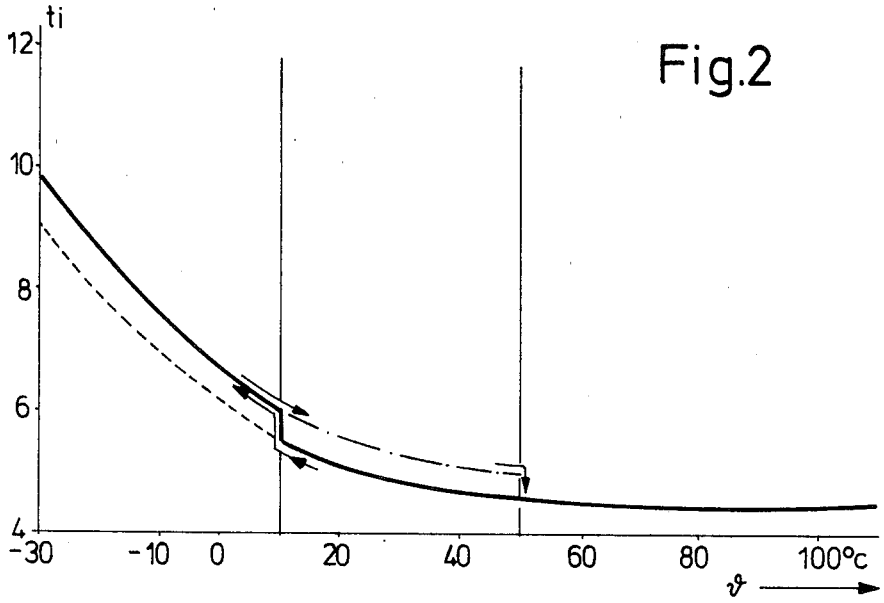
FIG. 2 is a diagram for the temperature-dependent mixture enrichment.

In FIG. 2 the duration of injection pulses is plotted against the temperature of the coolant. It shows the relatively long duration of injection at low temperatures whereas, starting from about 60° C., it is not necessary to enrich the air-fuel mixture. The supplementary enrichment for the removal of the error of the intake-air temperature is shown by the solid, the dotted, and the dash-dotted curves and by the arrows in FIG. 2. At a starting temperature below 10° C. increased enrichment is effected which continues even beyond the upper limit temperature of 10° C. up to about 50° C. Above said limit temperature, the operation is switched over to the basic warm-up operation. Owing to the hysteresis, said basic warm-up operation will run through toward cooler temperatures up to the limiting value of 10° C., and below said temperature the operation is again switched over to increased enrichment. At starting temperatures above 10° C. an enrichment is selected, already at the start, in accordance with the basic warm-up operation. The object of the increased enrichment is to prepare an ignitable and optimum mixture (as soon as possible) for the combustion chamber of the internal-combustion engine, thereby reducing as soon as possible the component of harmful exhaust gases and increasing engine smoothness. As mentioned earlier, the value of the supplementary enrichment is chosen such that, on average, the error caused by the temperatures of the intake air is corrected. When starting the internal-combustion engine above temperature of 10° C., said supplementary enrichment is not effective, because in this case less warm-up enrichment is desired for reasons of exhaust emission.

Figure 3:
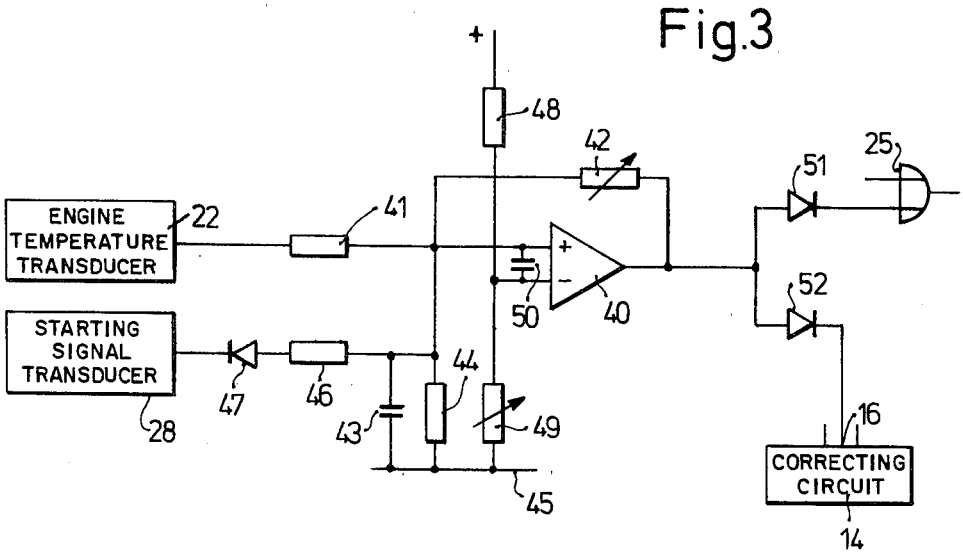
FIG. 3 is a preferred embodiment of the threshold element shown as a block diagram of FIG. 1.

FIG. 3 shows a detailed diagram of threshold element 24. The most important component of threshold element 24 is a differential amplifier 40, whose positive input is coupled via resistor 41 with transducer 22 for the temperature of the internal-combustion engine. Differential amplifier 40 is connected via a variable resistor 42 which determines the lower temperature threshold. From the positive input of differential amplifier 40 there is further connected a parallel combination of capacitor 43 and resistor 44 to ground cable 45 and, finally, a series arrangement of resistor 46 and diode 47 is connected to the output of starting-signal transducer 28. Said starting-signal transducer 28 delivers a negative signal during the starting and thereby shifts the potential across the positive input of differential amplifier 40 to a negative potential; this corresponds to a high temperature of the internal-combustion engine. There is connected at the negative input of differential amplifier 40 the center tap of a voltage divider made up of resistors 48 and 49 connected between the voltage supply lines, with the variable resistor 49 determining the upper temperature threshold of threshold element 24. Capacitor 50 is connected between both inputs of differential amplifier 40 and diodes 51 and 52 are each connected from the output of differential amplifier 40 to logic element 25 and to input 16 of correcting circuit 14.

An essential feature of the above-described invention is the activation of the lambda-control apparatus as a function of two temperature thresholds resulting from the readiness for service of the exhaust-gas sensor as determined by the sensor readiness circuit 21 and from a specified value of the temperature of the internal-combustion engine sensed by transducer 22. The development of threshold element 24 with a hysteresis has proved very useful, but it may be dispensed with depending on the layout of the entire injection system.

The foregoing represents a preferred exemplary embodiment of the invention, it being understood that variants thereof are possible within the spirit and scope of the invention, the latter being defined by the appended claims.

What is claimed and desired to be secured by Letters Patent of the United States is:

1. In a method of operation of an internal combustion engine with a fuel supply apparatus and a lambda-control apparatus for the control of the fuel-air mixture based on a certain lambda value, wherein the fuel quantity to be supplied to the engine by the fuel supply apparatus is regulated in accordance with signals representing the engine RPM, intake manifold air-flow rate, and exhaust gas composition, and wherein the lambda-control apparatus operates in accordance with the temperature of an exhaust-gas sensor, the improvement comprising the steps of:

determining an engine temperature by an engine temperature sensor;

enriching the fuel-air mixture in accordance with the engine temperature determined by the engine temperature sensor so that the fuel-air mixture is heavily enriched when the engine is cold and this enrichment is reduced to zero as the engine temperature rises;

supplying the engine temperature determined by the engine temperature sensor to a threshold switching element having a hysteresis characteristic, for generating an output signal which is switched in accordance with the engine temperature between one value corresponding to a low engine temperature and another value corresponding to a high engine temperature;

controlling the actuation of the lambda-control apparatus in accordance with the output signal of the threshold element so that the lambda-control apparatus is only switched on when the value of the threshold element output signal corresponds to a high engine temperature; and supplementarily enriching the fuel-air mixture in accordance with the output signal of the threshold element.

2. In a method of operation of an internal combustion engine with a fuel supply apparatus and a lambda-control apparatus for the control of the fuel-air mixture based on a certain value, wherein the fuel quantity to be supplied to the engine by the fuel supply apparatus is regulated in accordance with signals representing the RPM, intake manifold air-flow rate, and exhaust gas composition and wherein the lambda-control apparatus operates in accordance with the temperature of an exhaust-gas sensor, the improvement comprising the steps of determining the engine temperature by an engine temperature sensor so that the attainment of a certain engine temperature is included as a supplementary criteria for the operation of the lambda-control apparatus, applying information related to engine temperature to a threshold element so that the switching ON or OFF of the lambda-control apparatus in accordance with engine temperature is determined by threshold values of the threshold element having a hysteresis characteristic, and supplementarily enriching the fuel-air mixture in accordance with an output signal of the threshold element.

3. The method as claimed in claim 2, which further comprises the step of maintaining the output signal of the threshold element at a certain value during the engine starting process.

4. The method as claimed in claim 3, wherein said certain value of the threshold element output signal is the value corresponding to a high engine temperature.

5. The method as claimed in claim 1 or 4, which further comprises the steps of:

determining the operational readiness of the exhaust-gas sensor; and controlling the activation of the lambda-control apparatus in accordance with the operational readiness of the exhaust-gas sensor as well as in accordance with the threshold element output signal so that the lambda-control apparatus can be switched on by the threshold element only if the exhaust-gas sensor is operationally ready.

6. In an apparatus for the operation of an internal combustion engine including an intake manifold for supplying air to the engine, a transducer for sensing the air flow rate in the intake manifold, a transducer for sensing the RPM of the engine, a fuel supply apparatus for supplying fuel to the engine in accordance with the sensed engine RPM and intake manifold air flow rate, an exhaust-gas sensor for generating an output signal in accordance with the composition of the engine exhaust gas, and a lambda-control apparatus for controlling the fuel-air mixture supplied to the engine in accordance with the output signal of the exhaust-gas sensor, the improvement which comprises:

a temperature transducer, arranged to sense an engine temperature, for generating an engine temperature signal corresponding to the sensed engine temperature;

fuel enrichment means for enriching the fuel-air mixture in accordance with the engine temperature signal, so that the fuel-air mixture is heavily enriched when the engine is cold and this enrichment is reduced to zero as the engine temperature rises to a normal operating value;

a threshold switch element, having a hysteresis characteristic and connected to receive the engine temperature signal, for generating an output signal which is switched in accordance with the engine temperature signal between one value corresponding to a low engine temperature and another value corresponding to a high engine temperature;

a logic element connected to receive the sensor readiness signal and the threshold element output signal, for controlling the activation of the lambda-control apparatus so that the lambda-control apparatus is switched on only if the exhaust-gas sensor is operationally ready and if the value of the threshold element output signal corresponds to a high engine temperature;

supplementary fuel enrichment means for enriching the fuel-air mixture in accordance with the threshold element output signal; and starting control means, associated with the threshold element, for maintaining the threshold element output signal at a constant value during engine starting, to thus obtain a constant starting condition depending upon the engine temperature.

7. An apparatus as claimed in claim 6, wherein the starting control means maintains the threshold element output signal during starting of the engine at the value corresponding to a high engine temperature.

8. An apparatus as claimed in claim 7, wherein the threshold element comprises a differential amplifier having an output, a first input connected to a reference voltage source, and a second input connected to an output of the starting control means and to the output of the temperature transducer, for generating the threshold element output signal.

9. An apparatus as claimed in claim 6, wherein the sensor-readiness recognition circuit is arranged to sense the temperature of the exhaust gas sensor and generate a sensor-readiness signal indicating the operational readiness of the exhaust-gas sensor when the temperature of the exhaust-gas sensor exceeds approximately 250° C.

10. An apparatus as claimed in claim 6, wherein the switching values of the threshold element with hysteresis preferably lie at about 10° C. and at a value in the range of 50° C. to 85° C.

11. An apparatus as claimed in claim 6 wherein the logic element is an OR gate.

12. An apparatus as claimed in claim 6 wherein the engine temperature is derived from the temperature of at least one of the following:

the coolant, the lubricant, and the cylinder head.

13. An apparatus as claimed in claim 12 including means for changing the high and low temperature response values of the threshold element so that during the engine starting process, the output signal of the threshold element may be set at a certain value.

14. An apparatus as claimed in claim 6, wherein at engine starting temperatures below a certain value, the warm-up of the engine must have attained a temperature of preferably 50° to 85° C., in order to make the lambda-control apparatus be dependent upon the exhaust-gas sensor temperature.

* * * * *